US011110026B2

(12) United States Patent
Ayre

(10) Patent No.: US 11,110,026 B2
(45) **Date of Patent: *Sep. 7, 2021**

(54) AESTHETIC GLIDER FOR WALKERS

(71) Applicant: Steve James Ayre, Midland, MI (US)

(72) Inventor: Steve James Ayre, Midland, MI (US)

(73) Assignee: Steven James Ayre, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/995,354

(22) Filed: Jun. 1, 2018

(65) Prior Publication Data

US 2018/0369058 A1 Dec. 27, 2018

Related U.S. Application Data

(62) Division of application No. 15/953,631, filed on Apr. 16, 2018, now Pat. No. 10,080,698, which is a division of application No. 15/629,914, filed on Jun. 22, 2017, now Pat. No. 10,045,905.

(51) Int. Cl.
*A61H 3/02* (2006.01)

(52) U.S. Cl.
CPC ..... *A61H 3/0288* (2013.01)

(58) Field of Classification Search
CPC ..... A61H 3/0288
See application file for complete search history.

(56) References Cited

U.S. PATENT DOCUMENTS 5,317,788 A * 6/1994 Esposito ..... B62J 7/08 24/300
2014/0137388 A1* 5/2014 Campbell ..... F16G 11/025 29/461

OTHER PUBLICATIONS

Affidavit of Moshe Wilensky. (Year: 2019).*

* cited by examiner

*Primary Examiner* — Moshe Wilensky
(74) *Attorney, Agent, or Firm* — Young Basile Hanlon & MacFarlane, P.C.

(57) ABSTRACT

A walking aid accessory that is an aesthetic glider for a walker and a method of manufacturing.

20 Claims, 4 Drawing Sheets

AESTHETIC GLIDER FOR WALKERS

This application is a divisional application from application U.S. Ser. No. 15/953,631, filed Apr. 16, 2018, now pending, which is a divisional application from application U.S. Ser. No. 15/629,914, filed Jun. 22, 2017, now pending, from which priority is claimed.

BACKGROUND OF THE INVENTION

The present invention relates to medical walker aid accessories. The glider is used in the medical accessory field as an aid in allowing the walker to enhance stability of the movement of the patient that is using the walking aid. The gliders attach to the non-wheeled end of the walker.

The walkers come equipped with rubber ends that permit sliding of the non-wheeled ends. While the rubber ends provide stability, they do not function well on all surfaces, such as, carpeting and outside surfaces. Most users adapt by placing tennis balls on the ends to facilitate multi-surface use.

The present invention serves as an alternative to the rubber ends for multi-surface use. In addition to the multi surface use the present invention provides an aesthetic quality that allows the user to personalize their gliders to their own tastes.

THE INVENTION

The present invention is an aesthetic glider for walkers. The walking aid accessory comprises a cone-shaped vessel. The cone-shaped vessel has a top and a bottom.

Near the top, and inside the cone-shape, is a plurality of cone-shaped vertical channels having a top end and a bottom end. The cone-shaped vertical channels are essentially round at the top end and the cone-shaped channels are oval-shaped and larger at the bottom end than the round channel is at the top end.

There is at least two twist lock projections on the bottom and a centered opening vertically through the cone-shaped vessel.

There is an insert component having a top surface and a bottom surface and a central vertical projection, the top surface has twist lock openings through it and adjacent the central vertical projection.

In another embodiment, there is a method of manufacturing an accessory of this invention wherein the method comprises providing a cone-shaped vessel wherein the cone-shaped vessel has a top and a bottom.

Near the top, and inside the cone-shape vessel, there is a plurality of cone-shaped vertical channels having a top end and a bottom end, wherein the cone-shaped vertical channels are essentially round at the top end and the cone-shaped channels are oval-shaped and larger at the bottom end than the round channel is at the top end.

There is at least two twist lock projections on the bottom and a centered opening vertically through the cone-shaped vessel.

There is provided at least one filamentous decoration and the filamentous portion of the filamentous decoration is inserted into a channel in the vessel such that a portion of the filament surpasses the bottom end of the channel.

Thereafter, a lower portion of the filament is bent against itself and the bent filament is drawn into the channel tightly.

Thereafter, the insert component is inserted into the opening and twisted to lock the insert component to the cone-shaped vessel.

In a further embodiment, there is a method of anchoring a flexible, solid filament. The method comprises providing an anchoring element, wherein the anchoring element comprises a solid article. The solid article has contained in it, at least one cone-shaped channel through it. The cone-shaped channel has a top end and a bottom end, wherein each of the cone-shaped channels is essentially round at the top end and oval, and larger in size than the top end, at the bottom end.

Thereafter, providing at least one filamentous material and inserting a filament of the filamentous material into a channel in the vessel such that a portion of the filament surpasses the bottom end of the channel.

Thereafter, bending a bottom portion of the filament against itself and drawing the bent filament tightly into the channel.

BRIEF DESCRIPTION OF THE DRAWINGS

A flower pot is used herein as an illustration of an aesthetic glider for walkers wherein the filamentous decoration is not limited to flowers.

DETAILED DESCRIPTION OF THE DRAWINGS

Figure 1:
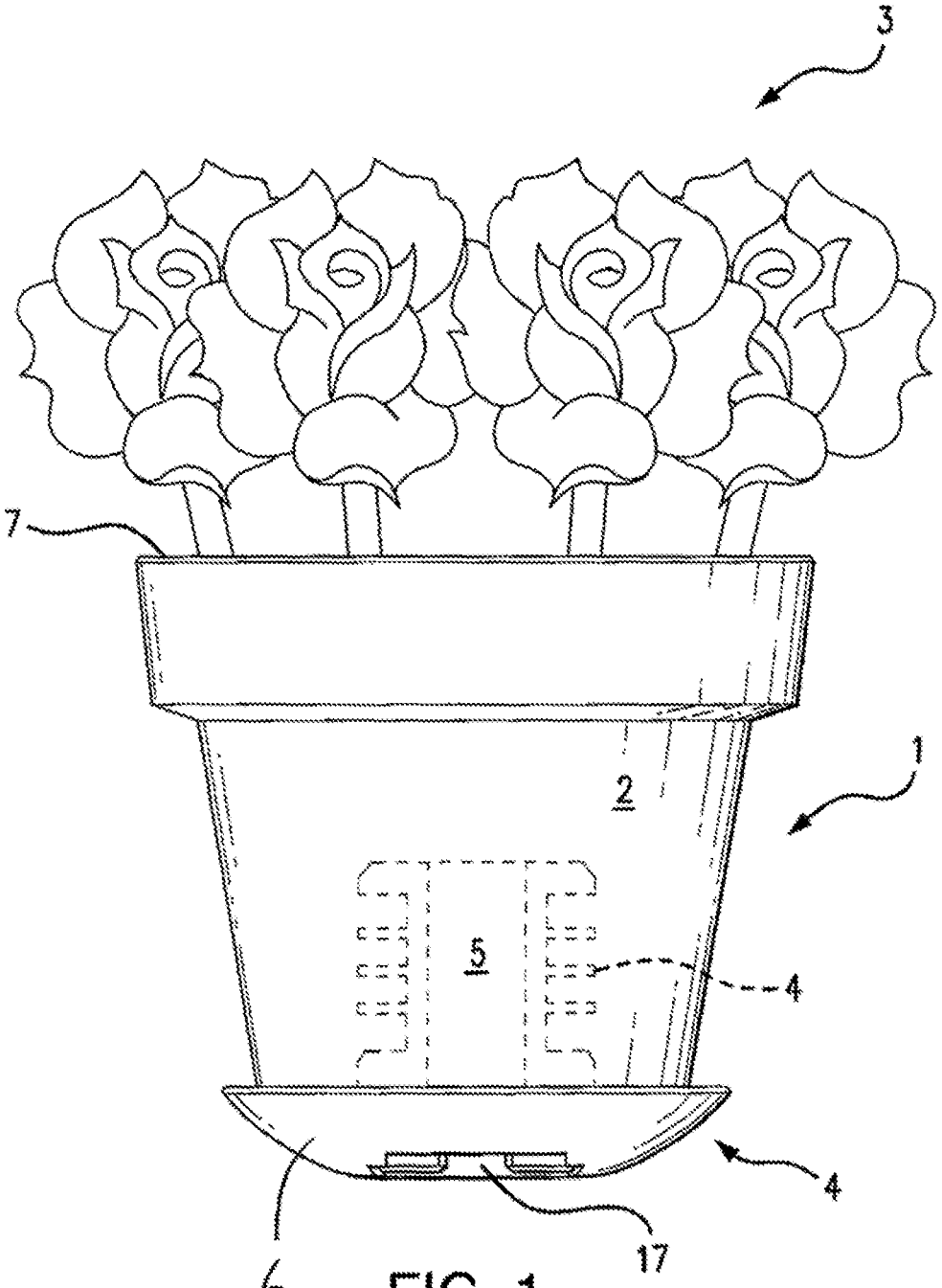
FIG. 1 is a full side view of a glider of this invention.

Turning now to FIG. 1 wherein there is shown a full side view of a glider 1 of this invention.

Shown is a cone-shaped vessel 2 containing a variety of filamentous decorations 3 which, for example, can be flowers.

The cone shaped vessel 2 is supported by an insert component 4. Shown in phantom is a vertical post 5 that is part of the insert component 4. The insert component 4 is rounded on the bottom 6 so that when used on a walker, it glides easily across most surfaces. The cone shaped vessel 2 also has a top 7.

Figure 2:
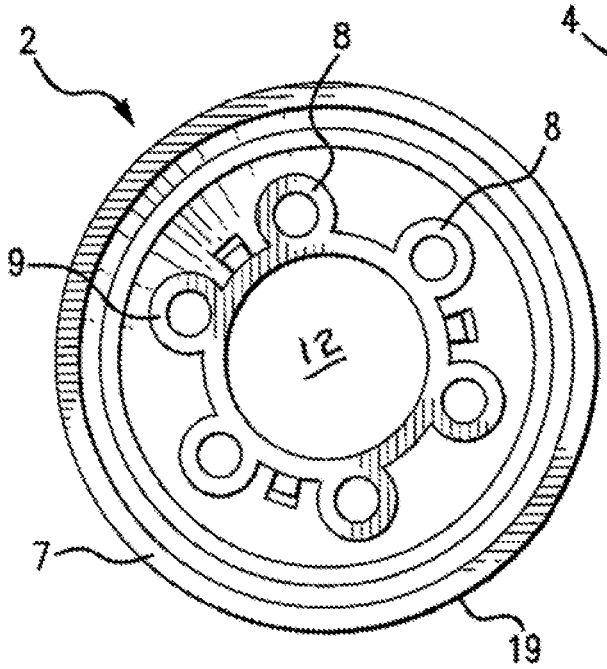
FIG. 2 is a full top view of the flower pot glider of FIG. 1.
Figure 3:
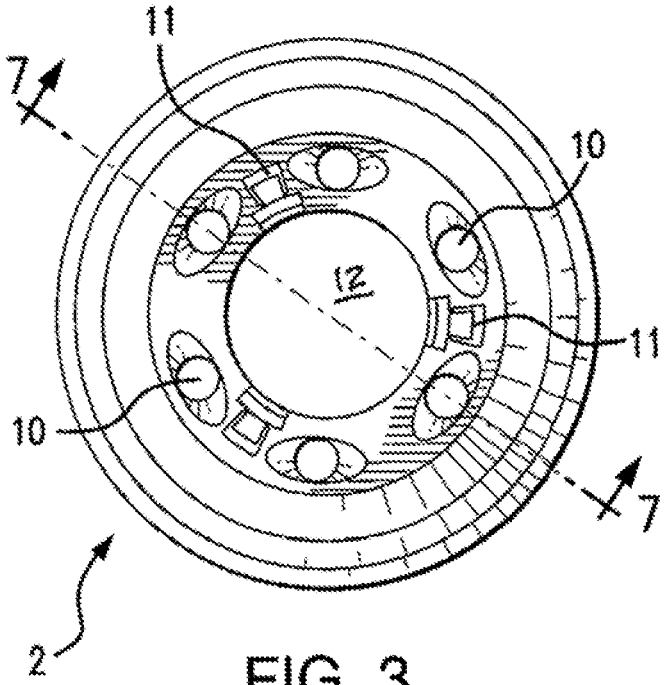
FIG. 3 is a full bottom view of the flower pot glider of this invention.

Near the top 7, and inside the cone-shaped vessel 2, there is a located a plurality of cone-shaped vertical channels 8 which also have a top end 9 (FIG. 2) and a bottom end 10 (FIG. 3). The cone-shaped vertical channels 8 are essentially round at the top end 9 and oval-shaped and larger at the bottom end 10. What is meant by "larger" is the bottom ends 10 are larger than the round channel at the top end 9.

Figure 5:
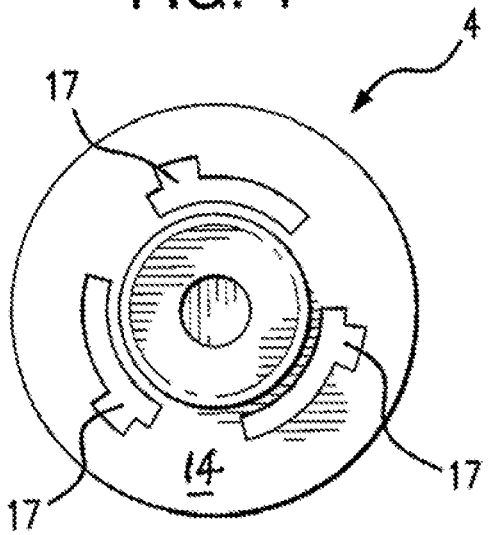
FIG. 5 is a full top view of the insert component.

There are at least two twist lock projections 11 on the bottom 10 of the cone-shaped vessel 2. FIG. 5 shows three, for example. There is a centered opening 12 vertically through the cone-shaped vessel 2.

Figure 4:
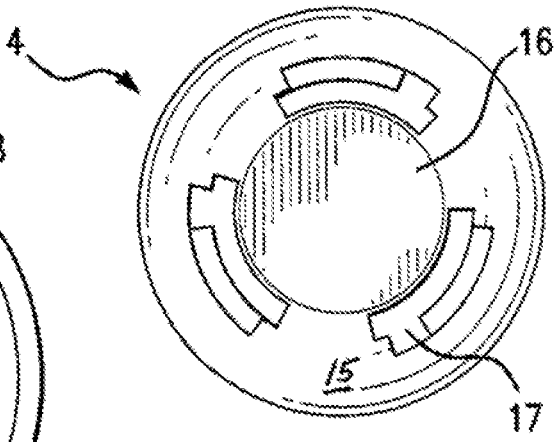
FIG. 4 is a full bottom view of the insert component of this invention.

The other component of the walking aid accessory is an insert component 4 (FIGS. 4, 5, and 6), having a top surface 14, and a bottom surface 15, a central vertical post 16 mounted on the top surface 14 thereof, and at least two indentions in the base 20 which are the openings 17. The top surface 14 has twist lock openings 17 through it and adjacent the central vertical post 5. The combination of the twist lock projections 11 of the cone-shaped vessel 2 and the twist lock openings 17 of the insert component 4 combine to lock the insert component 4 to the cone-shaped vessel 2 similar to a Luer Lok® configuration originally used in hypodermic needles and syringes. Luer lok is a registered trademark of Becton, Dickinson and Company, Franklin Lakes, N.J.

Turning now to FIG. 1, there is shown a full side view of the device 1 of this invention wherein there is shown the cone-shaped vessel 2 and a portion of the insert component 4, filamentous decoration 3, and central vertical post 5 shown in phantom in FIG. 1.

FIG. 2 is a full top view of the cone-shaped vessel 2 showing an outside rim 19, the plurality of cone-shaped vertical channels 8 and the centered opening 12. It should be noted that each of the cone-shaped vertical channels 8 is rounded at the top end 9 and as shown, they are evenly spaced. However, it is contemplated within the scope of this invention to provide cone-shaped vertical channels 8 in an irregular pattern as well.

FIG. 3 is a full bottom view of the cone-shaped vessel 2 showing the bottom end 10 of the cone-shaped vertical channels 8. Note that such cone-shaped vertical channels 8 are oval in construction at the bottom 10.

Also shown are the twist lock projections 11 on the bottom 10 of the cone-shaped vessel 2. There are shown three such projections, but it is contemplated within the scope of this invention that any desired number may be used within reason so that they all fit on the bottom surface 10.

Figure 6:
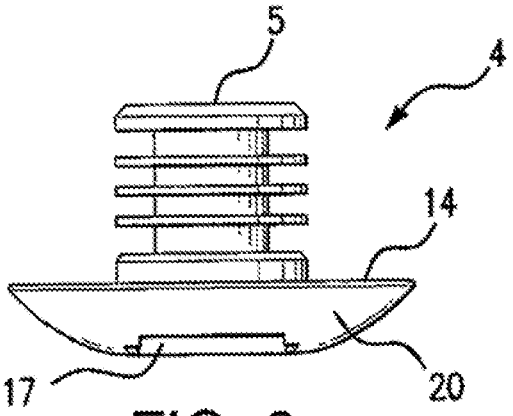
FIG. 6 is a full side view of the insert component.

Turning now to FIG. 6, there is shown a full side view of an insert component 4 showing the base 20 and the central vertical post 5. The central vertical post 5 is configured to frictionally insert into the centered opening 12 of the cone-shaped vessel 2.

Turning now to a method of manufacturing an accessory as described above, and referring to FIGS. 7 and 8, wherein both figures are cross sectional views of FIG. 1, absent the insert 4, and all filamentous decorations except one, there is shown the cone-shaped vessel 2, and the cone-shaped vertical channels 8. A filamentous decoration 3 is shown in one of the cone-shaped vertical channels 8. The method of manufacture requires providing a cone-shaped vessel 2, as described Supra.

Figure 7:
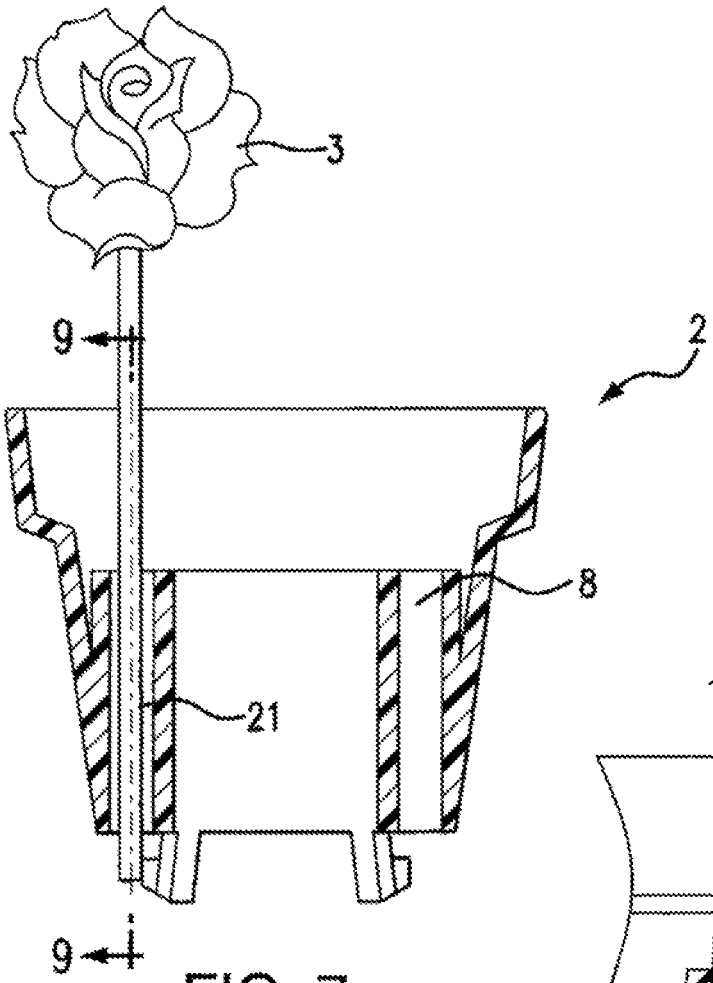
FIG. 7 is a cross sectional side view of a glider of this invention showing the filament of the filamentous decoration inserted through a vertical channel.
Figure 8:
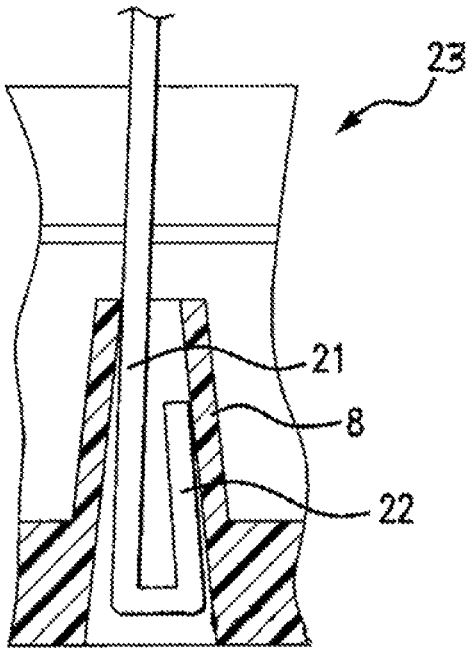
FIG. 8 is a cross sectional side view as in FIG. 7 wherein the filament is bent and drawn into the vertical channel.

Thereafter, providing at least one filamentous decoration 3, inserting the filament 21 of the filamentous decoration 3 into a cone-shaped channel 8 in the cone-shaped vessel 2 at the top 9 such that a portion of the filament 21 surpasses the bottom end 10 of the cone-shaped channel 8 as shown in FIG. 7. Thereafter, bending a bottom portion 22 of the filament 21 against itself as shown in FIG. 8, and then drawing the bent filament 21 into the cone-shaped channel 8 tightly which locks the filament 21 in the cone-shaped channel 8.

Thereafter, the insert component 4 is inserted into the centered opening 12 and twisted to lock the insert component 4 into the cone-shaped vessel 2.

Figure 9:
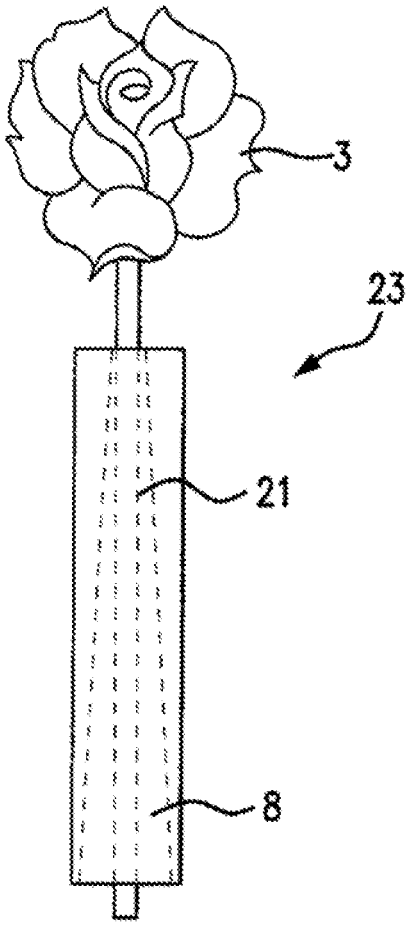
FIG. 9 is a full side view of an anchoring device with the filament of a filamentous decoration inserted in the channel.

There is a general method of anchoring flexible, solid filaments, the method comprising providing an anchoring element 23 as shown in FIG. 9, which is a round or square solid article, having at least one cone-shaped channel 8 through it, the cone-shaped channel 8 shown in phantom along with the filament 21 of the filamentous decoration 3.

Figure 10:
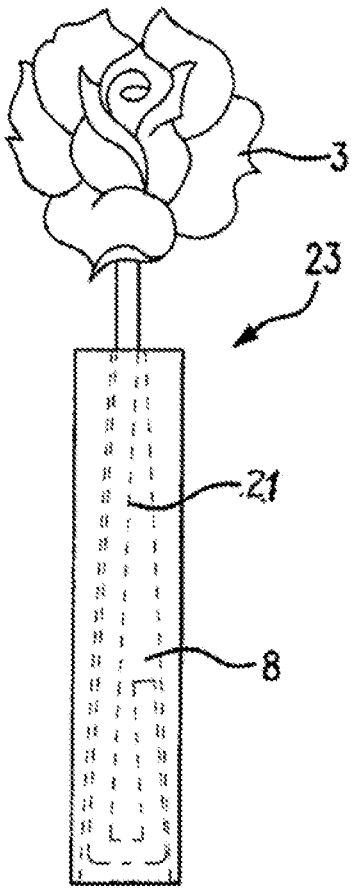
FIG. 10 is a full side view of the anchoring device of FIG. 9 with the filament of the filamentous decoration anchored.

Then one follows the method as described above for anchoring the filament 21 in the cone-shaped channel 8 as shown in FIG. 10, in phantom.

What is claimed is:

1. A method of anchoring a flexible, solid filament to a walking aid, the method comprising:

providing an anchoring element, the anchoring element comprising at least one channel extending there through, the channel having a first end and a second end, wherein the channel is larger in size at the first end than the second end;

inserting an end of the filament into the second end of the channel in the anchoring element such that the end of the filament surpasses the first end of the channel;

bending the flexible, solid filament adjacent itself;

drawing the bent filament into channel tightly; and attaching the anchoring element to the walking aid.

2. The method of claim 1, wherein the channel extends in a substantially longitudinal direction, a first set of opposing sides of the channel in a width direction are substantially parallel, a second set of opposing sides of the channel is a transverse direction are substantially oblique, and the longitudinal direction, the width direction, the transverse direction are substantially perpendicular to one another.

3. The method of claim 1, wherein a twist lock is used to attach the anchoring element to the walking aid.

4. The method of claim 1, wherein attaching the anchoring element comprises:

providing a first component having a base and a post extending from the base;

providing a second component having an outer shell and an inner tube, wherein the inner tube has a central opening extending therethrough that is sized to matingly receive the post of the first component in a first configuration, wherein the second component is supported by and locked to the first component in the first configuration, wherein the second component is separated from the first component in a second configuration, and wherein an outer periphery of the base of the first component in a first plane normal to a widest width of the base and an outer periphery of the outer shell of the second component in a second plane closest to the first component have a similar configuration; and attaching at least one of the first component or the second component to the walking aid.

5. The method of claim 4, wherein the base of the first component has a hemispherical configuration.

6. The method of claim 5, wherein the hemispherical configuration of the base has a planar portion and an arcuate portion opposite the planar portion, and wherein the planar portion is disposed closer to the post than the arcuate portion.

7. The method of claim 4, wherein the post of the first component is concentric with the base of the first component.

8. The method of claim 4, wherein the channel is disposed parallel to at least one of the post of the first component or the central opening of the second component.

9. The method of claim 4, wherein one of the first component or the second component has twist-lock projections, wherein the other of the first component or the second component has twist-lock openings, and wherein the twist-lock projections and the twist-lock openings lock the first component and the second component together in the first configuration.

10. The method of claim 9, wherein the twist-lock openings are on the base of the first component, and the twist-lock projections extend from a lower portion of the second component.

11. The method of claim 4, wherein a bore is defined in the post of the first component.

12. The method of claim 11, wherein the bore has a closed end within the post or the base of the first component.

13. The method of claim 12, wherein the bore is defined concentrically within the post.

14. The method of claim 1, wherein attaching the anchoring element comprises:

providing a first component having a base with a substantially hemispherical configuration and a post extending concentrically upwards from the base, wherein a bore is defined in the post of the first component;

providing a second component having an outer shell with a decorative element and an inner tube, wherein the inner tube has a central opening extending longitudinally therethrough that is sized to matingly receive the post of the first component in a first configuration, wherein the second component is supported by and locked to the first component in the first configuration, and wherein the second component is separated and disconnected from the first component in a second configuration; and attaching at least one of the first component or the second component to the walking aid.

15. The method of claim 14, wherein the substantially hemispherical configuration of the base has a substantially planar portion and a substantially arcuate portion opposite the substantially planar portion, and wherein the substantially planar portion is disposed closer to the post than the substantially arcuate portion.

16. The method of claim 14, wherein the post of the first component is concentric with the base of the first component.

17. The method of claim 14, wherein one of the first component or the second component has twist-lock projections, wherein the other of the first component or the second component has twist-lock openings, and wherein the twist-lock projections and the twist-lock openings lock the first component and the second component together in the first configuration.

18. The method of claim 17, wherein the twist-lock openings are on the base of the first component, and the twist-lock projections extend from a lower portion of the second component.

19. The method of claim 14, wherein the channel is disposed parallel to at least one of the post of the first component or the central opening of the second component.

20. The method of claim 1, wherein attaching the anchoring element to the walking aid comprises:

attaching the anchoring element to an end of the walking aid.

* * * * *